US005957617A

United States Patent [19]

Delamere

[11] Patent Number: 5,957,617

[45] Date of Patent: Sep. 28, 1999

[54] HIGHWAY MARKER

[76] Inventor: Peter A. Delamere, 227 Balmoral Ave., Toronto, Canada, M4V 1K1

[21] Appl. No.: 08/977,607

[22] Filed: Nov. 25, 1997

[51] Int. Cl.[6] ..... E01F 9/06

[52] U.S. Cl. ..... 404/11; 404/14

[58] Field of Search ..... 404/10, 11, 12, 404/13, 14, 16; 116/63 R

[56] References Cited

U.S. PATENT DOCUMENTS

| | | | |
|---|---|---|---|
| 3,836,275 | 9/1974 | Finch | 404/13 |
| 3,901,614 | 8/1975 | Overacker . | |
| 4,504,169 | 3/1985 | Jones . | |
| 4,597,691 | 7/1986 | Clarke . | |
| 4,871,280 | 10/1989 | Modlin | 404/11 X |
| 4,955,982 | 9/1990 | Paulos | 404/11 |
| 5,069,577 | 12/1991 | Murphy . | |

*Primary Examiner*—James A. Lisehora
*Attorney, Agent, or Firm*—Shoemaker and Mattare, Ltd.

[57] ABSTRACT

A reflective pavement marker includes a hollow, hermetically sealed base having a flexible top wall defining at least one downward recess. The base is installed in an opening in a roadway, with the top wall flush with the surface. In each recess there is provided a reflector unit which includes an upper portion projecting upwardly above the top of the base, and converging upwardly so that impact from a moving object will cause a camming action that urges the reflector unit downwardly. The reflector unit includes at least one light-reflective component supported and protected by the upper portion.

6 Claims, 2 Drawing Sheets

HIGHWAY MARKER

This invention relates generally to highway markers typically placed along the centre line of a highway and including a light-reflective plate to make the marker visible at night.

BACKGROUND OF THIS INVENTION

The lanes on roads and highways are normally separated by 10 cm wide painted lines. Typically, the lanes are made visible at night by dropping glass bead onto the wet paint, to make the lines reflective. This method, however, has a number of drawbacks. Firstly, the glass bead used is usually not of a high quality, thus giving a low initial reflectivity. Secondly, the beads tend to be subject to wear by vehicle tires and abrasion from grit on the road. Thirdly, the beads are positioned against the road surface, and are thus covered with water during rain. The film of water interferes with the reflectivity, and makes the line difficult to see at night.

Wet night visibility is greatly enhanced by the addition of reflective raised pavement markers. These raised markers are constituted essentially by a block of durable plastic into which a cube-cornered reflector is imbedded. These markers are cemented to the road along the painted line, and pick up and reflect the light of the approaching vehicle. Such markers have the following advantages. Firstly, the reflector is moulded from durable plastic allowing the quality to be controlled, therefore producing a consistently high brightness reflector. Secondly, the reflector is mounted in the body of the marker in such a way that the reflector is protected to some degree from tire wear and abrasion. Thirdly, the reflector is mounted above the surface of the road and is not covered with water during rainy weather. It therefore performs well in rain.

Such raised pavement markers are very effective and are widely used where climatic conditions are such that snowplowing is unnecessary. Generally, these raised markers cannot withstand the impact of a snowplow.

Many attempts have been made to produce a raised marker that will survive impact from snowplows. There are two basic ways to accomplish this.

The first method is to make a marker that is strong enough to withstand the impact of a snowplow. The most successful product uses this method. The unit is a cast steel insert that is inlaid into the road and retained using epoxy. When in position, the casting exhibits two parallel steel ramps protruding up from the road surface. A reflector is cemented between the ramps for protection. When impacted by the snowplow, the casting deflects the blade upwardly far enough that the blade does not make contact with the reflector. Although these units are widely used, they do have a number of problems due to the extreme impact. Firstly, although the ramp height of the marker may be as little as ¼" in 6", the plow blade will jump more than 6" off the road, leaving a strip of road unplowed. Secondly, the shock of impact is considerable, and is very uncomfortable for the plow driver. It also has a detrimental effect on the mechanicals of the truck. Thirdly, the impact between the carbide blade of the plow and the casting often results in cracked blades. Fourthly, the casting of the marker is heavy. If it is not installed perfectly, there is a risk that the plow blade will catch on the casting and pull it out of the road. If this happens at high speeds, the casting can become a projectile which can endanger oncoming vehicles and their occupants.

The second method is to make a marker that deflects out of the way on impact with the plow blade without damaging the marker, thus overcoming the problems encountered with the cast unit.

The Prior Art

Several previous patents utilize the deflection principle in order to avoid damage both to the reflector and the plow blade.

U.S. Pat. No. 3,901,614, Overacker, issued Aug. 26, 1975, discloses a reflector unit having a hard transparent material in the upper part of the body and a flexible transparent material forming the base. The base is locked into a hole or recess in the roadway utilizing a suitable compound. The construction is such that the flexible material of the base allows the hard material of the upper portion to move downwardly somewhat under the force of an impact.

U.S. Pat. No. 4,504,169, Jones, issued Mar. 12, 1985, provides a road stud which is displaced downwardly when run over by a vehicle. When this occurs, special flaps are also displaced downwardly, which causes the reflection elements to be wiped by resilient wiping lips to remove dirt.

U.S. Pat. No. 4,597,691, Clarke, issued Jul. 1, 1986, discloses a resilient structure in which a light-reflective surface is depressed to a level coincident with or below the surrounding pavement. Once the force is removed, the light reflecting surface returns to an elevation above the road surface.

U.S. Pat. No. 5,069,577, Murphy, issued Dec. 3, 1991, discloses a unitary flexible pavement marker which is hollow and formed in such away that the upward dome is depressed or "folded" downwardly into the cavity provided below it, upon impact by a tire or a snowplow blade. When the tire or blade have passed by, the marker returns to its original position.

The foregoing prior art approaches to the design of a marker capable of deflecting out of the way on impact retain certain disadvantages which it is an aspect of this invention to overcome.

The Overacker U.S. Pat. No. 3,901,614 requires the provision of a spherical component with a hard top section and a resilient bottom section, both having a particular index of refraction, and both remaining optically transparent. It is obvious that repeated abrasion from impact would eventually ruin the optics of the various portions of the component and interfere with its light-reflecting capability.

The U.S. Pat. No. 4,504,169, Jones, is directed to a unit that has been tested in Ontario with discouraging results. The part of the unit which sits above the road and is subject to contact with a snowplow blade is made of an elastomeric plastic which is relatively soft and tends to be cut by the jagged edge of the blade. The body of the unit is not sealed, and thus allows water and dirt to enter into the unit. The water freezes and this causes the unit to seize so that it will not depress, thus resulting in failure. The general shape of the unit, which was designed to include a method of cleaning the front of the reflectors when depressed, is such that it is subject to be being snagged by the snowplow blade.

U.S. Pat. No. 4,597,691, Clarke, uses only a single dome. The sealing of the unit is accomplished by mechanically compressing gaskets, however these sealing surfaces are subject to leaking and failure. According to the patent, the housing is hollow with an upper open end and a closed lower end. The design of the unit tends to be quite complex, utilizing many parts and mechanical fasteners. This results in increased costs, and greater likelihood of failure.

U.S. Pat. No. 5,069,577, Murphy, is directed to a configuration which was tested in Ontario and failed. It is believed that the main reason for failure is that the soft plastic material protruding above the road surface, when struck by the plow blade, tended to be pinched rather than deflected downward, and the pinching action compressed the trapped air to a pressure which ruptured the back side of the dome.

GENERAL DESCRIPTION OF THIS INVENTION

In view of the drawbacks of the prior art described above, it is an object of one aspect of this invention to provide a reflective pavement marker comprising:

a hollow, hermetically sealed base having a flexible top wall defining at least one downward recess, the base being adapted to be installed in an opening in a road surface such that the top wall lies at or below the road surface, and, for each said recess, a reflector unit having a lower portion snugly received in the recess and an upper portion projecting upwardly above the top wall of the base, said upper portion having the shape of a conical frustum converging upwardly such that impact from a horizontally moving object will cause a camming action that urges the reflector unit downwardly;

at least one light-reflecting component supported and protected within an indentation in said upper portion;

each downward recess in the top wall being substantially cylindrical in configuration, the lower portion of each reflector unit being also substantially cylindrical, the said lower portion being sized so as to achieve a snag fit within the corresponding downward recess;

the outer periphery of the lower portion of each reflector unit exhibiting a flat region which achieves an asynmetrical, rotation-resistant grip with the respective downward recess.

It is an object of a further aspect of this invention to provide a reflective pavement marker comprising:

a hollow, hermetically sealed base having a flexible top wall defining a plurality of downward recesses, the base being adapted to be installed in an opening in a road surface such that the top wall lies at or below the road surface, and, for each said recess, a reflector unit having a lower portion snugly received in the respective recess and an upper portion projecting upwardly above the top wall of the base, said upper portion converging upwardly such that impact from a horizontally moving object will cause a camming action that urges the reflector unit downwardly;

at least one light-reflecting component supported and protected by each said upper portion;

the recesses being disposed such that a plow blade passing over the marker impacts each reflector unit at a different time, thus averaging out the total impact.

It is an object of further aspect of this invention to provide a reflective pavement market comprising:

a hollow, hermetically sealed base having a flexible top wall defining a plurality of downward recesses, the base being adapted to be installed in an opening in a road surface such that the top wall lies at or below the road surface, and, for each said recess, a reflector unit having a lower portion snugly received in the recess and an upper portion projecting upwardly above the top wall of the base, said upper portion converging upwardly such that impact from a horizontally moving object will cause a camming action that urges the reflector unit downwardly;

at least one light-reflecting component supported and protected within an indentation in each said upper portion;

each downward recess in the top wall being substantially cylindrical in configuration, the lower portion of each reflector unit being also substantially cylindrical, each said lower portion being sized so as to achieve a snug fit within the corresponding downward recess;

the plurality of recesses being disposed such that a plow blade passing over the marker impacts each reflector unit at a different time, thus averaging out the total impact.

GENERAL DESCRIPTION OF THE DRAWINGS

One embodiment of this invention is illustrated in the accompanying drawings in which like numerals denote like parts throughout the several views, and in which.

DETAILED DESCRIPTION OF THE DRAWINGS

Figure 1:
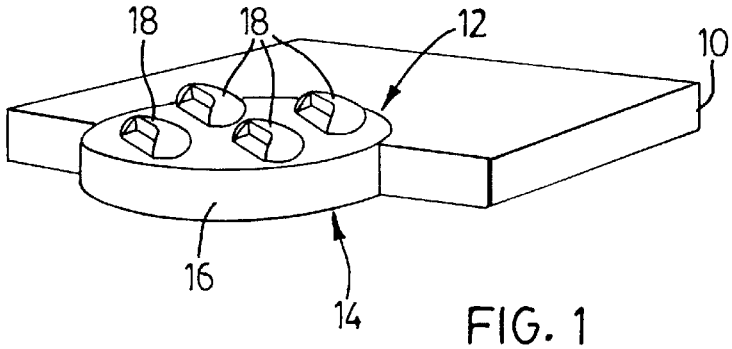
FIG. 1 is a perspective view of a reflective pavement marker, located in an opening in a road surface.

Attention is first directed to FIG. 1 which shows, in perspective, the upper surface layer 10 of a typical roadway, containing an opening 12 which is circular in plan view and has a substantially flat bottom. Located in the opening 12 is a reflective payment marker shown generally at 14, which includes a base 16 that receives a plurality of reflector units 18 described below in greater detail.

Figure 2:
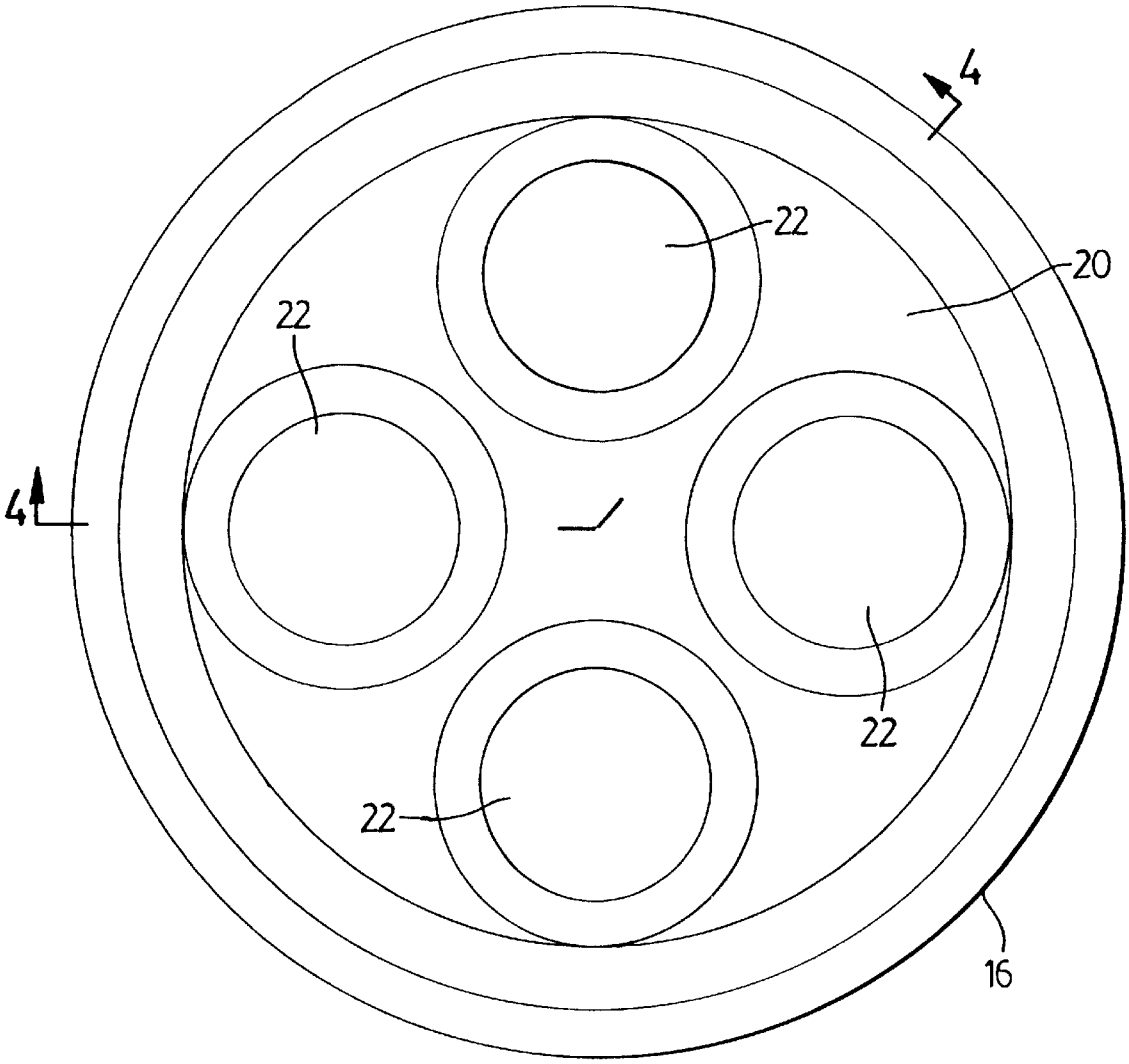
FIG. 2 is a top plan view of the base of the reflective pavement marker shown in FIG. 1.
Figure 4:
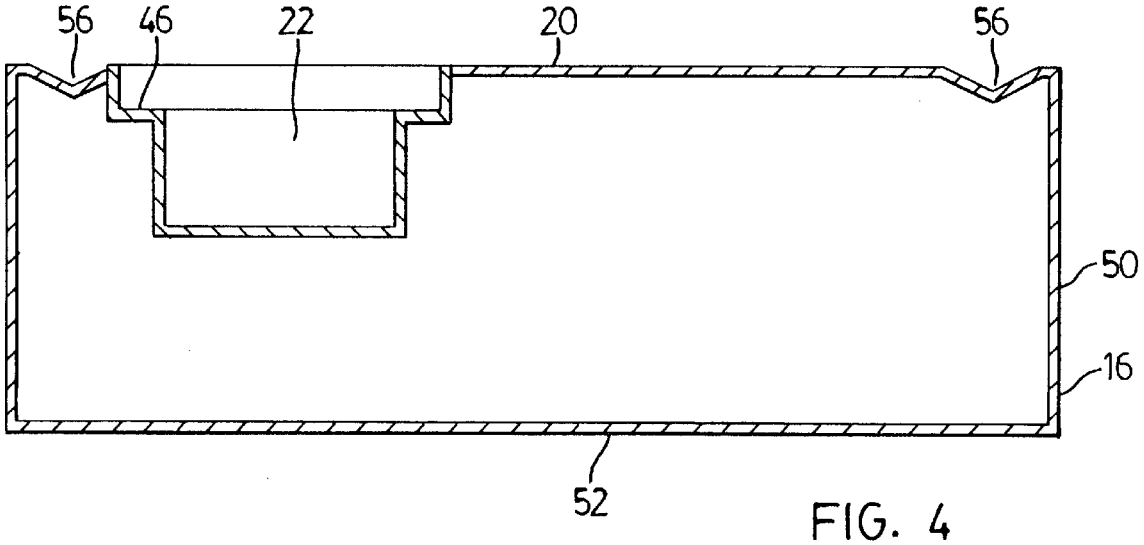
FIG. 4 is a vertical, axial sectional view through the base of FIG. 2 taken at the line 4—4 in FIG. 2.

Attention is directed to FIGS. 1, 2 and 4, from which it will be seen that the base is a hollow, hermetically sealed unit having a flexible top wall 20 which defines at least one downward recess 22 (four recesses in the embodiment illustrated).

Figure 3:
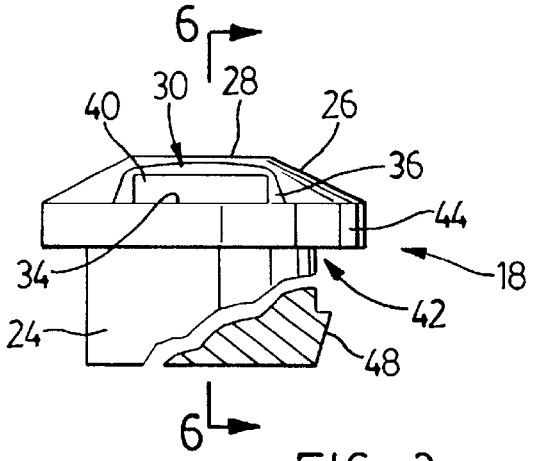
FIG. 3 is a partly broken-away view, both elevational and sectional, of a reflector unit suitable for use with the base of FIG. 1.
Figure 5:
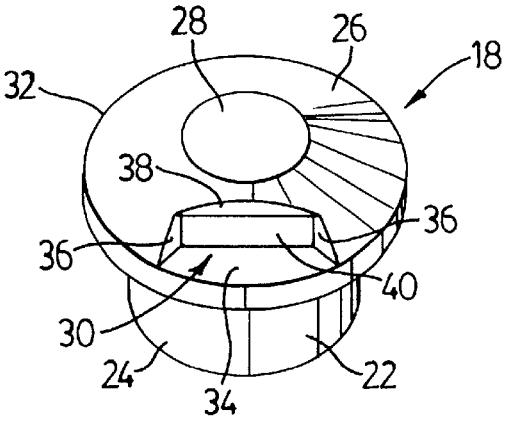
FIG. 5 is a perspective view of the reflector unit shown in FIG. 3.
Figure 6:
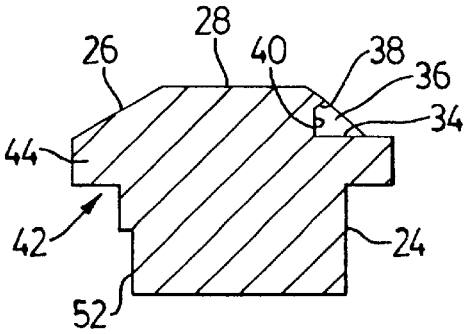
FIG. 6 is an axial sectional view, taken at the line 6—6 in FIG. 3.

For each recess 22 there is provided a reflector unit best seen in FIGS. 3, 5 and 6. The illustrated reflector unit has a lower cylindrical portion 24 sized to be snugly received in the corresponding recess 22. Each reflector unit 18 also defines an upper portion 26 which projects upwardly above the top wall 20 of the base 16. As seen, the upper portion 26 has the shape of a conical frustum which converges upwardly and terminates at a flat, circular top surface 28. Due to the shape of the upwardly converging conical frustum, any impact from a horizontally moving object (such as a snowplow blade) will cause a camming action that urges the reflector unit 18 downwardly.

The upper portion 26 defines a recess 30 spanning about 60°, located adjacent the larger periphery (outside circular edge) 32 of the frusto-conical upper portion 26.

As illustrated, the recess 30 defines a flat bottom surface 34, two substantially vertical side surfaces 36, an upper surface 38, and a reflector surface 40.

As seen in FIG. 6, the reflector surface 40 is protected by the downward and inward slope of the upper surface 38.

The lower portion 24 of the reflector unit 18 defines an inward step 42 adjacent an outward flange 44, which in turn defines the bottom of the upper portion 26.

As can be seen in FIG. 4, each recess 22 in the base 16 defines an upward step 36 which is sized to snugly receive the flange 44 of the respective reflector unit 18.

FIG. 3 shows, in the lower right hand corner, a variant of the construction for the reflector unit. More specifically, there is provided around the periphery of the lower end of the lower portion 24 a continuous or discontinuous "barb" 48 having a greatest diameter which is somewhat larger than the internal diameter at the bottom of the recess 22, thereby providing a "force-fit" between the reflector unit and the base 16. Because the base 16 (including the portions defining recess 22) is made of resilient material, the recess 22 can expand to accommodate the barb 48.

Returning to FIG. 4, the base 16 is seen to include, in addition to the top wall 20 and the recess 22 (only one seen in section of FIG. 4), a cylindrical side wall 50 and circular bottom wall 52. The base 16 is preferably made from tough but flexible plastic, such that the top wall 20 can deform to allow the reflector units 18 to be depressed on impact. The trapped air in the hermetically sealed cylinder defined by the base 16 acts as an air spring. As can be seen in FIG. 4, the preferred embodiment includes a V-shaped groove 56 adjacent the perimeter of the base, thus providing excess material to allow the upper wall 20 to depress without excessive warping of the unit. Typically, the base 16 may be cemented into the road surface using an epoxy cement, abituminous adhesive or any other appropriate material. When installed in this manner, there is no place where water, ice or sand can penetrate the unit and stop its action.

Preferably, the reflector units 18 are moulded integrally from a hard, tough, abrasion-resistant plastic. The reflective surface 40 in the recess 30 can be made from high quality durable sheeting such as Reflexite™, or from crystal bead material ("Cats' Eyes"), or can be moulded in plastic and combined with the reflector unit 18 when the same is moulded.

An advantage in using multiple reflector units 18 in a single base 16 is that the units can be disposed such that a plow blade passing over the marker will impact each reflection unit at a different time, thus averaging out the total impact. This allows the profile to be kept as low as possible. As a result, the compression of the sealed cylinder defined by the base 16 occurs in stages. By making the reflector units 18 separate from the base 16, it is possible to use materials that are best suited to each of these components.

The structure defined above makes it possible to replace reflector units in the field.

Also, the particular construction of the reflector unit 18 allows the provision of reflective plates on opposite sides, allowing the units to be utilized as one-way or two-way reflectors.

Because the upper portion 26 of each reflector unit 18 has the shape of an upwardly convergent conical frustum, the same can be impacted from any direction.

It should be mentioned that the reflective surface 40 of each unit 18 is not required to be strictly vertical, as illustrated. Vertical orientation may be utilized because the reflective materials readily available work in this position. However, it is contemplated that the reflector may be installed in such a way that it slopes downwardly toward the bottom, since this is expected to reduce the accumulation of dirt.

A further variant is to provide a flat such as that shown at 52 in FIG. 6, at a given location around the bottom of the lower portion 24 of the reflector unit 18. This will provide a means of resisting rotation of the reflector unit 18 with respect to the base 16.

Preferably, the reflector units 18 are made as an integral body from a material which is selected from the group consisting of: thermosetting plastic, thermoplastic plastic, concrete and metal.

The provision of the outward step 46 in the recess 22, cooperating with the outward step 42 seen in FIG. 6, ensures a smooth transmission of downward force from the reflector unit 18 to the upper wall 20 of the base 16, thus minimizing stress concentration and prolonging the life of the pavement marker.

While one embodiment of this invention has been illustrated in the accompanying drawings and described hereinabove, it will be evident to those skilled in the art that changes and modifications may be made therein, without departing from the essence of the invention as set forth in the appended claims.

I claim:

1. A reflective pavement marker comprising:

a hollow, hermetically sealed base having a flexible top wall defining at least one downward recess, the base being adapted to be installed in an opening in a road surface such that the top wall lies at or below the road surface, and, for each said recess, a reflector unit having a lower portion snugly received in the recess and an upper portion projecting upwardly above the top wall of the base, said upper portion having the shape of a conical frustum converging upwardly such that impact from a horizontally moving object will cause a camming action that urges the reflector unit downwardly;

at least one light-reflecting component supported and protected within an indentation in said upper portion;

each downward recess in the top wall being substantially cylindrical in configuration, the lower portion of each reflector unit being also substantially cylindrical, the said lower portion being sized so as to achieve a snug fit within the corresponding downward recess;

the outer periphery of the lower portion of each reflector unit exhibiting a flat region which achieves an asymmetrical, rotation-resistant grip with the respective downward recess.

2. The marker claimed in claim 1, in which each reflector unit is made from a hard, tough, abrasion-resistant and impact-resistant material.

3. The marker claimed in claim 2, in which each reflector unit is an integral body, and said material is selected from the group consisting of: thermosetting plastic, thermoplastic plastic, concrete and metal.

4. A reflective pavement marker comprising:

a hollow, hermetically sealed base having a flexible top wall defining a plurality of downward recesses, the base being adapted to be installed in an opening in a road surface such that the top wall lies at or below the road surface, and, for each said recess, a reflector unit having a lower portion snugly received in the respective recess and an upper portion projecting upwardly above the top wall of the base, said upper portion converging upwardly such that impact from a horizontally moving object will cause a camming action that urges the reflector unit downwardly;

at least one light-reflecting component supported and protected by each said upper portion;

the recesses being disposed such that a plow blade passing over the marker impacts each reflector unit at a different time, thus averaging out the total impact.

5. The marker claimed in claim 4, in which said upper portion of each reflector unit has the shape of a conical frustum with an indentation for receiving said light-reflecting component.

6. A reflective pavement marker comprising:

a hollow, hermetically sealed base having a flexible top wall defining a plurality of downward recesses, the base being adapted to be installed in an opening in a road surface such that the top wall lies at or below the road surface, and, for each said recess, a reflector unit having a lower portion snugly received in the recess and an upper portion projecting upwardly above the top wall of the base, said upper portion converging upwardly such that impact from a horizontally moving object will cause a camming action that urges the reflector unit downwardly;

at least one light-reflecting component supported and protected within an indentation in each said upper portion;

each downward recess in the top wall being substantially cylindrical in configuration, the lower portion of each reflector unit being also substantially cylindrical, each said lower portion being sized so as to achieve a snug fit within the corresponding downward recess, the plurality of recesses being disposed such that a plow blade passing over the marker impacts each reflector unit at a different time, thus averaging out the total impact.

* * * * *